US011896074B2

(12) United States Patent
Gerrard et al.

(10) Patent No.: US 11,896,074 B2
(45) Date of Patent: Feb. 13, 2024

(54) HEAD TOP

(71) Applicant: RPB Safety, LLC, Royal Oak, MI (US)

(72) Inventors: Alan J. Gerrard, Christchurch (NZ); Samuel M. Kelly, Christchurch (NZ); Patrick Bruyn, Christchurch (NZ); Julia Bartnick-Thumm, Christchurch (NZ); Edward S. M. Williams, Christchurch (NZ); James A. Te Aika, Christchurch (NZ); Jonathan Kettle, Christchurch (NZ)

(73) Assignee: RPB Safety, LLC, Royal Oak, MI (US)

( * ) Notice: Subject to any disclaimer, the term of this patent is extended or adjusted under 35 U.S.C. 154(b) by 0 days.

(21) Appl. No.: 17/515,344

(22) Filed: Oct. 29, 2021

(65) Prior Publication Data

US 2022/0132970 A1 May 5, 2022

Related U.S. Application Data

(60) Provisional application No. 63/110,339, filed on Nov. 5, 2020, provisional application No. 63/109,018, filed on Nov. 3, 2020, provisional application No. 63/108,278, filed on Oct. 30, 2020.

(51) Int. Cl.
*A42B 3/04* (2006.01)

(52) U.S. Cl.
CPC ..... *A42B 3/0406* (2013.01)

(58) Field of Classification Search
CPC ..... A42B 3/0406; A42B 3/18; A42B 3/22; A42B 3/064; A42B 3/145; A42B 3/127; A42B 3/20; A41D 13/11; A62B 23/02
USPC ..... 2/422
See application file for complete search history.

(56) References Cited

U.S. PATENT DOCUMENTS

| | | | | |
|---|---|---|---|---|
| 4,462,119 | A * | 7/1984 | Rudd | A42B 3/221 2/424 |
| 9,610,198 | B2 | 4/2017 | Hofer-Kraner et al. | |
| 10,362,829 | B2 * | 7/2019 | Lowe | A42B 3/128 |
| 11,090,192 | B2 * | 8/2021 | Sernfält | F16P 3/00 |
| 11,291,265 | B2 * | 4/2022 | Jefferis | A42B 3/286 |
| 2009/0235437 | A1 | 9/2009 | Springer et al. | |
| 2013/0319421 | A1 | 12/2013 | Hitchcock et al. | |
| 2015/0245682 | A1 * | 9/2015 | McGinn | A42B 3/185 2/424 |
| 2016/0021965 | A1 * | 1/2016 | Mayerovitch | A42B 3/064 2/414 |
| 2017/0105470 | A1 * | 4/2017 | Eaton | A42B 3/064 |
| 2017/0215510 | A1 * | 8/2017 | Demers | A42B 3/222 |

(Continued)

*Primary Examiner* — Timothy K Trieu
(74) *Attorney, Agent, or Firm* — William H. Honaker; Dickinson Wright PLLC

(57) ABSTRACT

A head top has a frame for mounting on a user's head. The frame has a viewing opening for a user to see out of the frame. A shield is mounted to the frame, and can be moved between a open and closed positions. A pivot arm connects the shield to the frame and is mounted to the inside of both the frame and shield to avoid exposure. An outer mount and inner mount can also be provided to automatically adjust the width of the head top. A hinge connects them allowing the inner mount to laterally pivot with respect to the outer mount to accommodate users with different head sizes. A forehead member also adjusts to a user's forehead.

33 Claims, 11 Drawing Sheets

(56) References Cited

U.S. PATENT DOCUMENTS

| | | | |
|---|---|---|---|
| 2017/0325534 | A1 | 11/2017 | Noordzij et al. |
| 2020/0170329 | A1 | 6/2020 | Bohn et al. |

* cited by examiner

HEAD TOP

CROSS REFERENCE TO RELATED APPLICATIONS

This application claims the benefit of U.S. Provisional Application Ser. No. 63/108,278 filed Oct. 30, 2020, U.S. Provisional Application Ser. No. 63/109,018 filed Nov. 3, 2020, and U.S. Provisional Ser. No. 63/110,339 filed Nov. 5, 2020, all of which are incorporated herein by reference in their entirety.

STATEMENT REGARDING FEDERALLY SPONSORED RESEARCH

NONE.

TECHNICAL FIELD

This invention relates generally to apparatus for head tops and more specifically harnesses used in head tops, an adjustable forehead frame and a visor or face shield that seals against the head top and has internal hinges.

BACKGROUND OF THE INVENTION

Head tops or head gear such as for example face shields, helmets, hoods, visors, and capes are common in the medical, pharmaceutical, and industrial fields to provide a layer of protection to users in difficult environments. These devices can also include a PAPR or supplied air source to provide filtered air to the user and positive pressure within the covering around the user's face.

For example, the applicant's T-link® has a face shield and a padded headliner and head suspension system, relieving the user of aches and strains on their neck and shoulders through its even weight distribution. A hood can be attached to the suspension system as well. It has a fully adjustable ratchet system that ensures a personalized and secure fit for all head types maximizing stability and enabling the respirator to move with user's head. Utilizing these innovative design features ensures an unrestricted range of movement combined with unrivalled comfort, so the user can focus on the job at hand.

Applicant's PX5® is an example of a PAPR, positive air pressure respirators, that have pressurized air supplied to the head gear or helmet. This enables a user to breath as they normally would as the air supply is propelled into the user's breath zone through a fan or supplied air. The air is filtered through HE filters.

Head mounts for mounting head tops or gear on a person's head are common. A problem with them is comfort. Discomfort can occur from a range of sources; one source is head tops that do not fit properly for different head sizes and head tops applying pressure or rubbing against the person's head, face, or chin. Head mounts are uncomfortable because they cannot be properly sized for all users. Head tops, such as helmets, visors, face shields, etc. can be difficult to easily adjust for a range of large and small heads.

Most head tops have a head harness that connects to and supports the head tops and fits snugly over the user's head. Head harnesses have side and top straps that surround the user's head. But most head tops do not have the ability to adjust the width of the head harness independently of the head top itself. Most harnesses can adjust for the height of the head and the depth of the head but cannot easily adjust for the width of the wearers head. This is particularly difficult if the head top is rigid, as it cannot flex inwards to the wearers head when the head harness is tightened. Additionally, the head top may have to flex outward for wearers with large heads.

Head tops, especially face shield types, can be front heavy and often include head harness features that contact with the wearers face to provide stability. Existing products rely on the softness of a thicker pad, for example a pad made of soft foam to adjust for different face and head sizes. These products have a soft face piece directly attached to the lens frame of the head mount. These soft face pieces attempt to conform to the user's face, but they have disadvantages. Disadvantages include discomfort due to the direct contact around the user's face; they can be hot to wear and cause the user to sweat; they can cause facial irritation; and they can be less affective when worn by bearded users for example.

They also restrict movement or make it difficult to move the jaw. This is a disadvantage to using the whole face rather than just the forehead for the structural interface.

In some applications the head top can have a pivoting hinged face shield. This allows the user to raise the shield. The hinge on this type of shield is on the exterior of the frame containing the face shield. As is common with these types of protection systems, the hood and cape can be disposable after longer periods of use, but the face shield and head gear are not disposable. They are reused. But, before reuse, all exterior surfaces must be cleaned. Since the hinge is an exterior surface, it must be cleaned as well, which is difficult and time consuming.

What is needed is a self-adjusting head harness that adjusts for the user's head sizes between small and large without flexing the head top and provide adequate support for front heavy head gear remaining comfortable to wear by all users. Overall, what is needed is a comfortable head mount that is comfortable for all users.

What is also needed is a face shield that can be raised and lowered but doesn't have exposed hinges. Additionally, what is needed is a face shield that can be raised and lowered and is comfortable to wear, whether it is raised or lowered.

SUMMARY OF THE INVENTION

In general terms, this invention provides a head harness that can automatically adjust inwardly and outwardly depending upon the size of the user's head. The adjustability is obtained without jeopardizing the head tops stability, or the comfort of the user. The head top can also be adjusted to fit comfortably to the user's forehead for added comfort. If a face shield is used, the internal hinge allows for easier cleaning and adds comfort to the user because the hinges can be positioned for enhanced comfort.

The present invention provides an adjustable head harness mount with an outer mount having a first connector for connecting the outer mount to a head top and an inner mount having a second connector for connecting the inner mount to a head harness. A hinge connects the outer mount to the inner mount. The hinge allows the inner mount to pivot with respect to the outer mount laterally with respect to one another to accommodate users with different head sizes. In this way, the adjustable head harness mount pivots to accommodate different user's head diameters.

The second connector of the present invention has two spaced receivers with slots for receipt of a strap on a head harness. It further includes a stability rail and a stability receiver. The stability rail can slide within the stability receiver to provide guides for the inner mount to pivot with respect to the outer mount laterally with respect to one another to accommodate users with different head sizes.

The hinge can be a living hinge, a mechanical hinge, or any other device to allow the first and second connectors to pivot with respect to one another.

The present invention also includes an adjustable forehead frame that has a forehead member having a body with a first radius of curvature. The body has opposed free ends. The main body is adapted to connect to a head top or headgear. A head strap or rear head harness portion connects to the free ends. The head strap when tightened draws the free ends to a second radius of curvature which is less than the first radius of curvature so that the forehead frame snugly fits against a user's head.

In another embodiment of the forehead frame, a first wing extends from one of the opposed free ends and a second wing extends from the other opposed free end. The first and second wings can be moved with respect to the main body from a first position to a second position, the first and second wings each having an adjustable second radius of curvature which is less than the first radius of curvature when the first and second wings are in the second position.

The invention also includes a head top or head gear that has a frame for mounting on a user's head. The frame has a viewing opening for a user to see through. The viewing opening has a perimeter. A shield is mounted to the frame and can be moved between a first position wherein the shield covers the viewing opening and a second position wherein the viewing opening is exposed.

The shield has a peripheral edge and at least one pivot arm connecting the shield to frame. The pivot arm extends from adjacent the peripheral edge through the frame. In this way, the pivot arm is concealed within the shield and the frame when the shield is in the closed position.

These and other features and advantages of this invention will become more apparent to those skilled in the art from the detailed description of a preferred embodiment. The drawings that accompany the detailed description are described below.

DETAILED DESCRIPTION OF A PREFERRED EMBODIMENT

Figure 1:
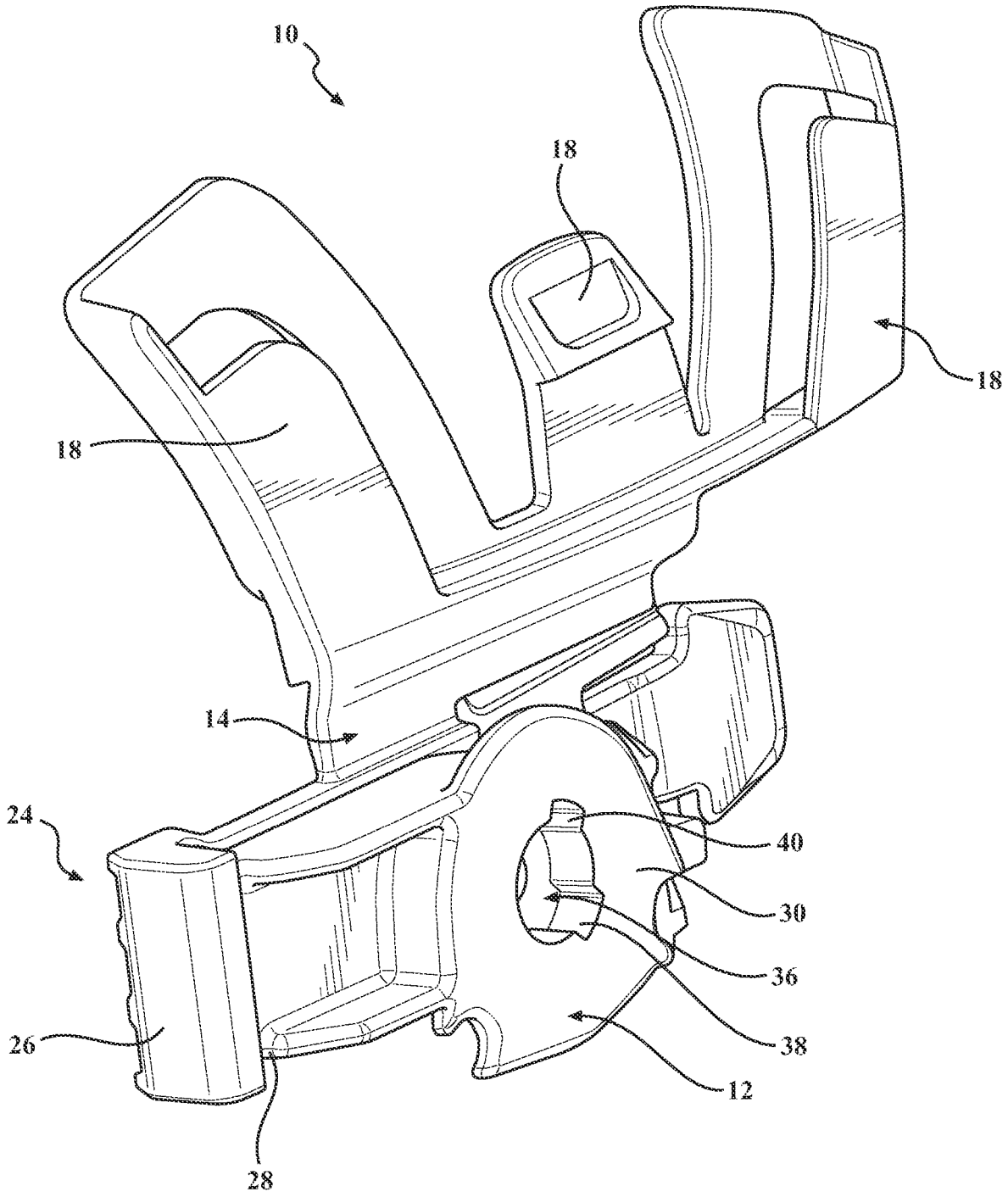
FIG. 1 is a perspective view of the self-adjusting head harness mount of the present invention.
Figure 2:
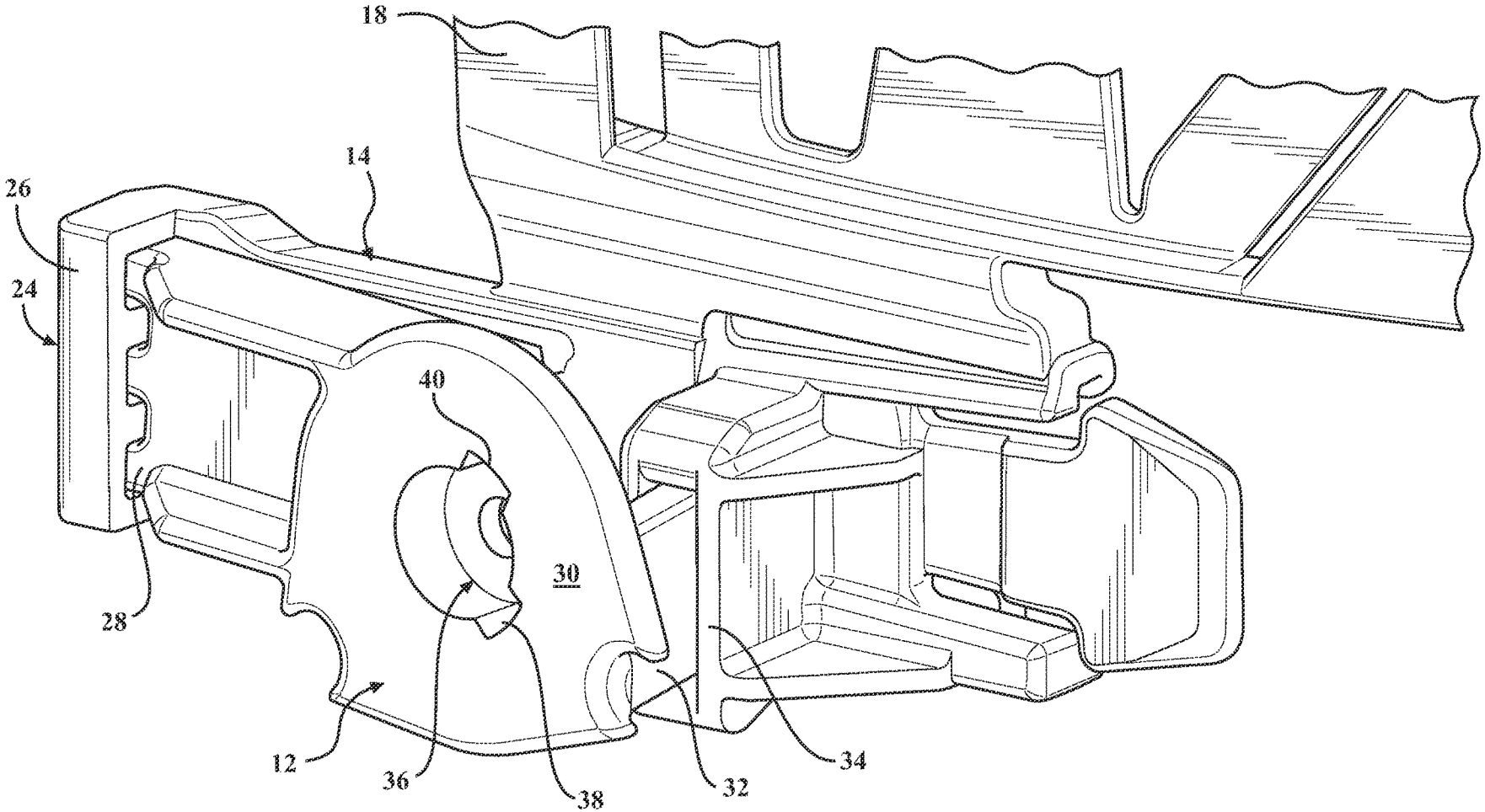
FIG. 2 is a partial perspective view.

The present invention has been separated into three different inventions, the self-adjusting head harness 10, the adjustable forehead frame 110 and the self-sealing internal hinge respirator face shield 210. These inventions have been disclosed separately for ease of explanation and description, but it should be appreciated that they can be used in combination or separately as desired.

With reference to FIGS. 1 through 4, the self-adjusting head harness mount of the present invention is shown generally at 10. Mount 10 has two main parts, an outer mount 12 that attaches rigidly to a head top 15, and an inner mount 14 that attaches to a head harness 16, see FIGS. 5 and 6. The head top shown is a visor, but it should be noted that use of the term head top should be taken broadly to include anything that can be attached to a head harness including but not limited to a helmet, hardhat, visor, face shield, a light, magnifying glasses etc. Overall, it would be useful for any application where something is mounted to a user's head.

Figure 7:
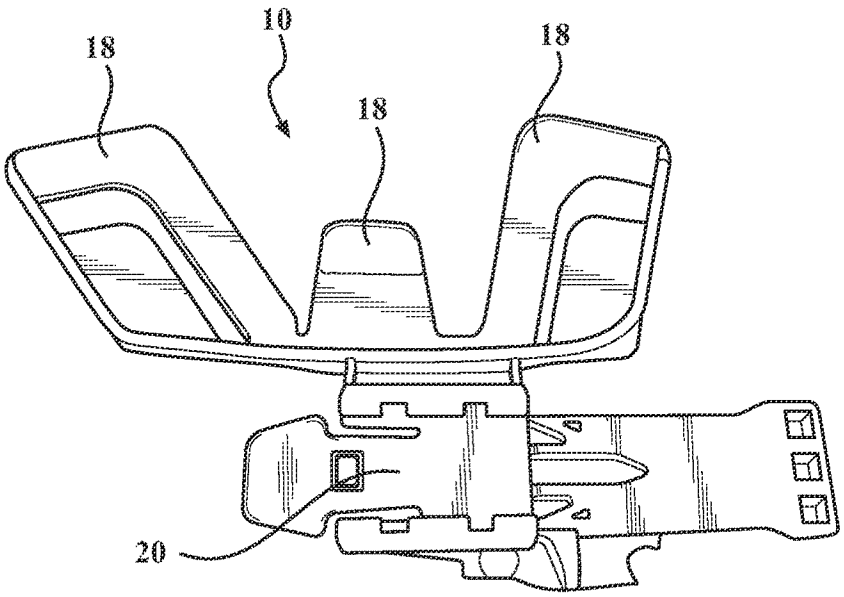
FIG. 7 is a rear view of the present invention.

The inner mount 14 has connectors 18 that attach the inner mount 14 to the head harness 16. In the disclosed connector 18 there are two spaced receivers and a lock between the receivers. Additionally, with reference to FIG. 7, the connector has a track 20 that is provided to receive a guide on the head harness. This track allows the harness 16 to be adjusted horizontally but maintains vertical stability. It should be appreciated that other styles of connectors 18 could be used depending upon the harness 16.

The inner mount 14 rotates and or flexes about a pivot point 22 with the outer mount 12 to provide the width range for differing head sizes. The pivot point is illustrated as a hinge 24, with a housing 26 that receives the proximal end 28 of the outer mount 12. Although shown as a mechanical hinge 24, the hinge or pivot could be a pin, a live hinge, or any other connector that will allow the outer and inner mounts 12 and 14 to move or flex with respect to one another. The distal end 30 of connector 12 has a stability rail 32 that is received within a receiver 34. The head harness mount 10 stays stable due to the two attachment points between parts 12 and 14 while at the same time the two parts can move with respect to one another for adjustment to accommodate different head sizes.

The outer mount 12 has a recess 36 that receives a mating protrusion on the head top. The recess 36 has angled keyways 38 and 40. The mating protrusion has mating keys (not shown). By angling the connection, the weight of the head top naturally applies tension to the mount system to remove wobble and add stability to the head top.

Figure 3:
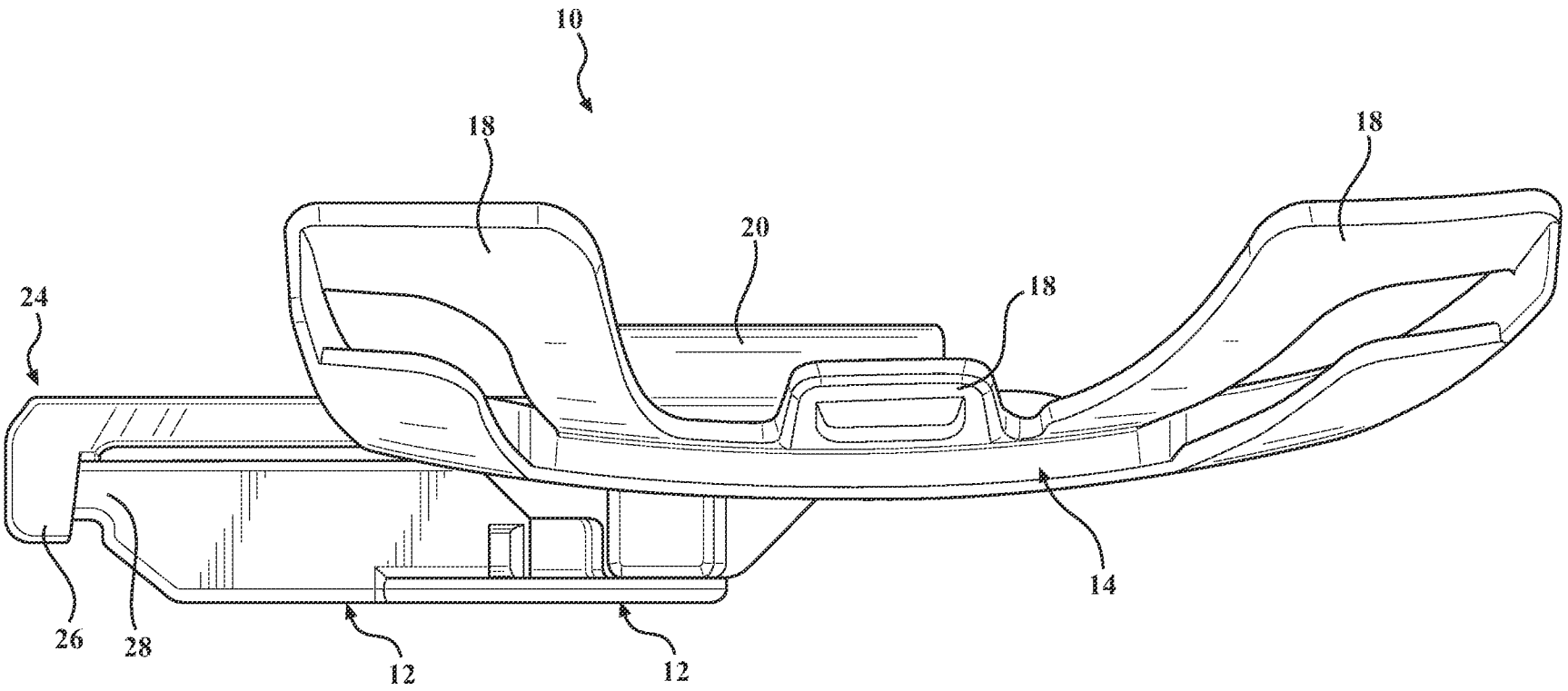
FIG. 3 is a top view with the head harness adjusted for a large head.
Figure 4:
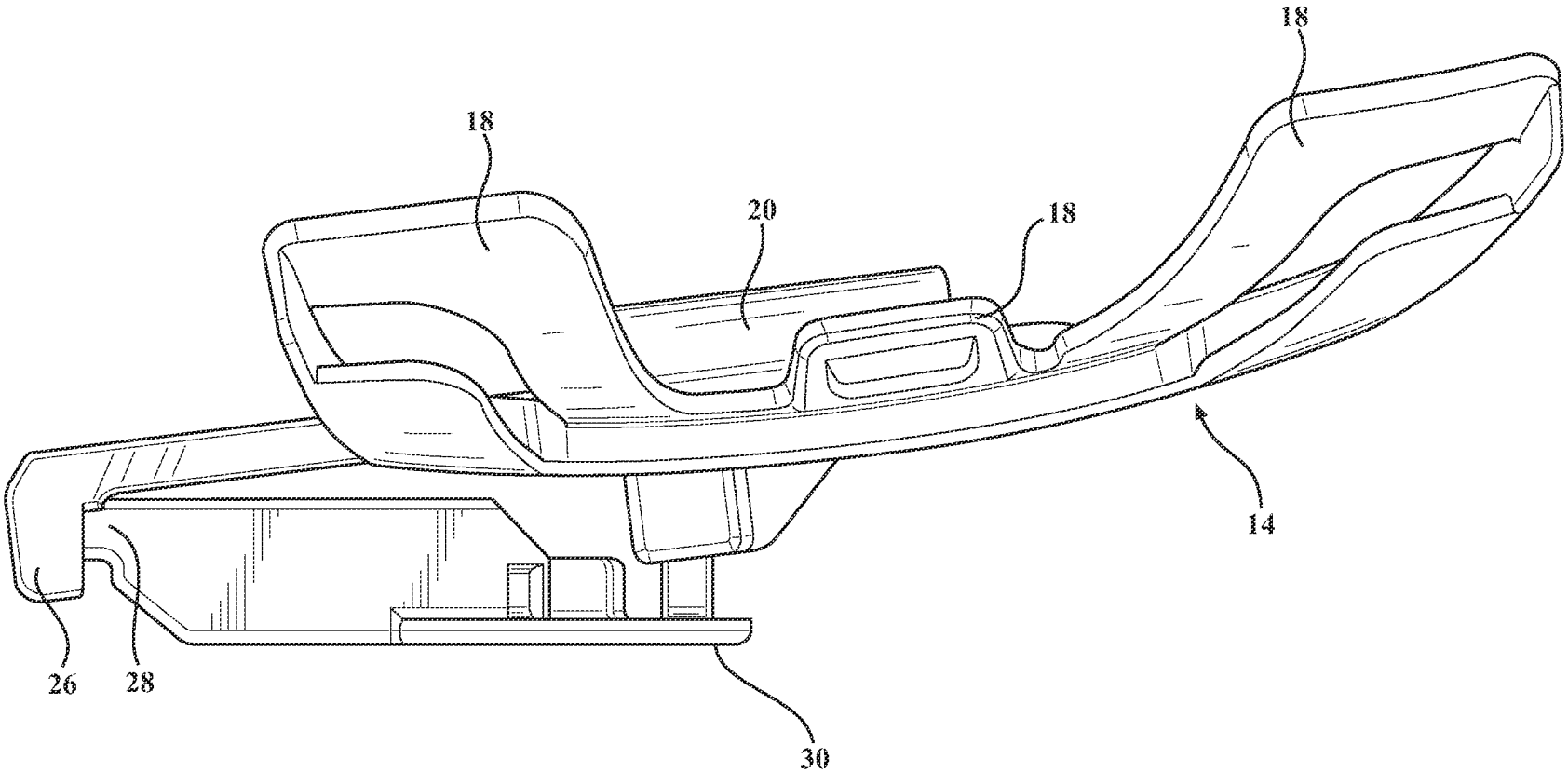
FIG. 4 is a top view with the head harness adjusted for a small head.
Figure 5:
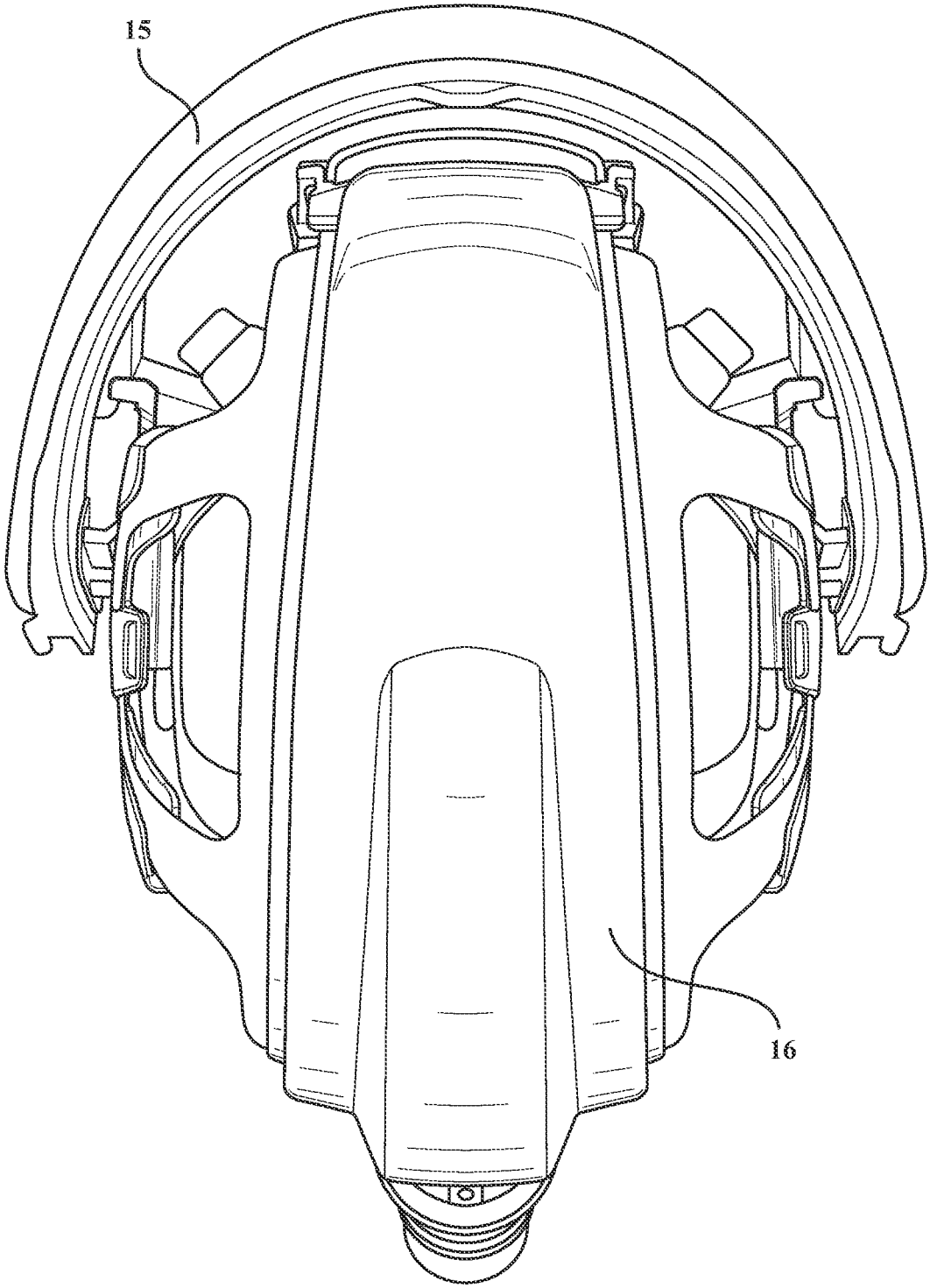
FIG. 5 is a top view of a head harness with a visor attached.
Figure 6:
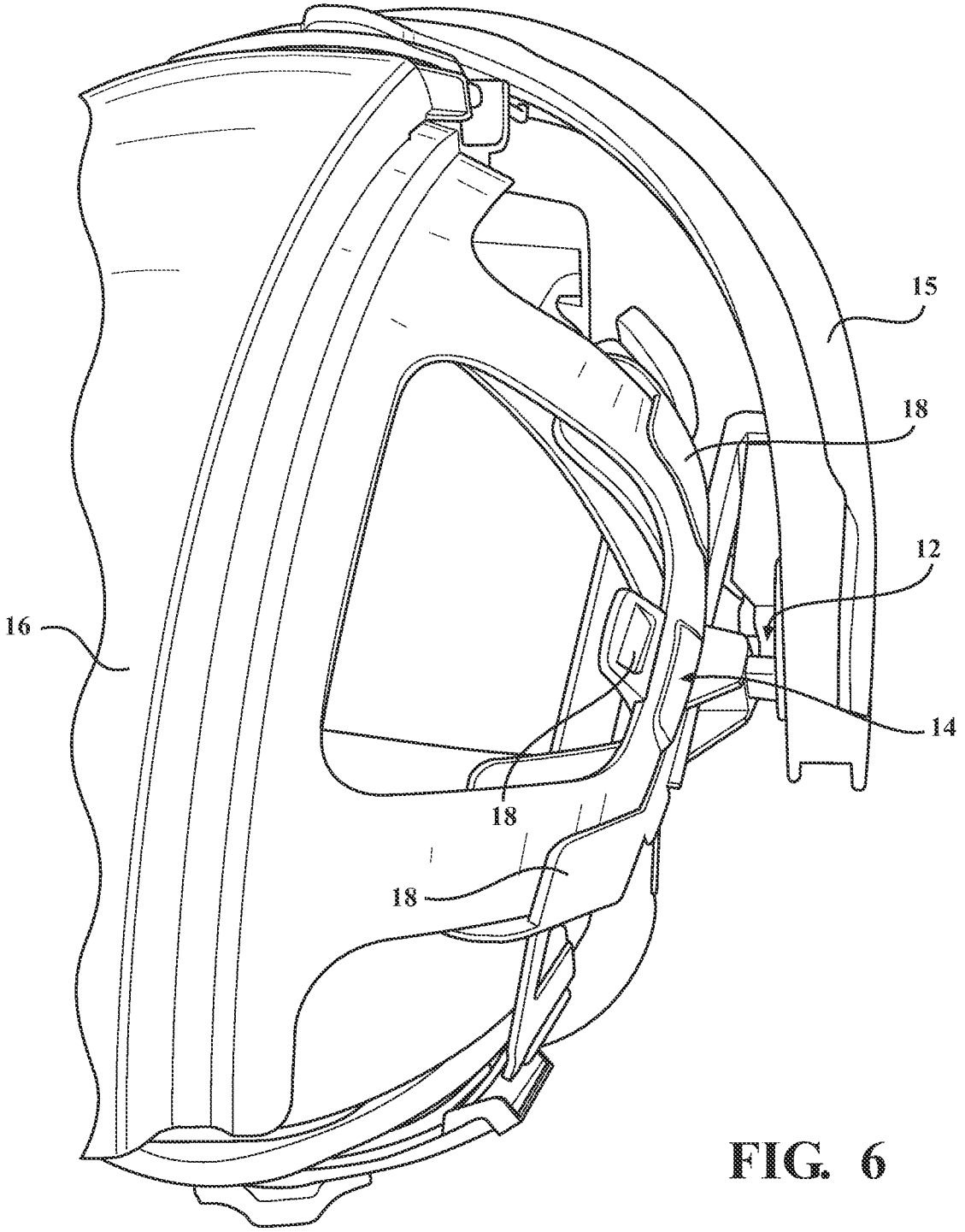
FIG. 6 is a partial top view of a head harness with a visor attached.

In use, the user puts the head harness 16 on over their head. The head harness 16 can be adjusted in the normal manner to fit the user's head size. Adjustment of the head harness 16 doesn't affect the head top 15. If the user has a small head, the inner mount 14 pivots away from the outer mount 12 as shown in FIGS. 4, 5 and 6. If the users head is large, the inner mount 14 pivots towards the outer mount 12 as shown in FIG. 3.

Figure 8:
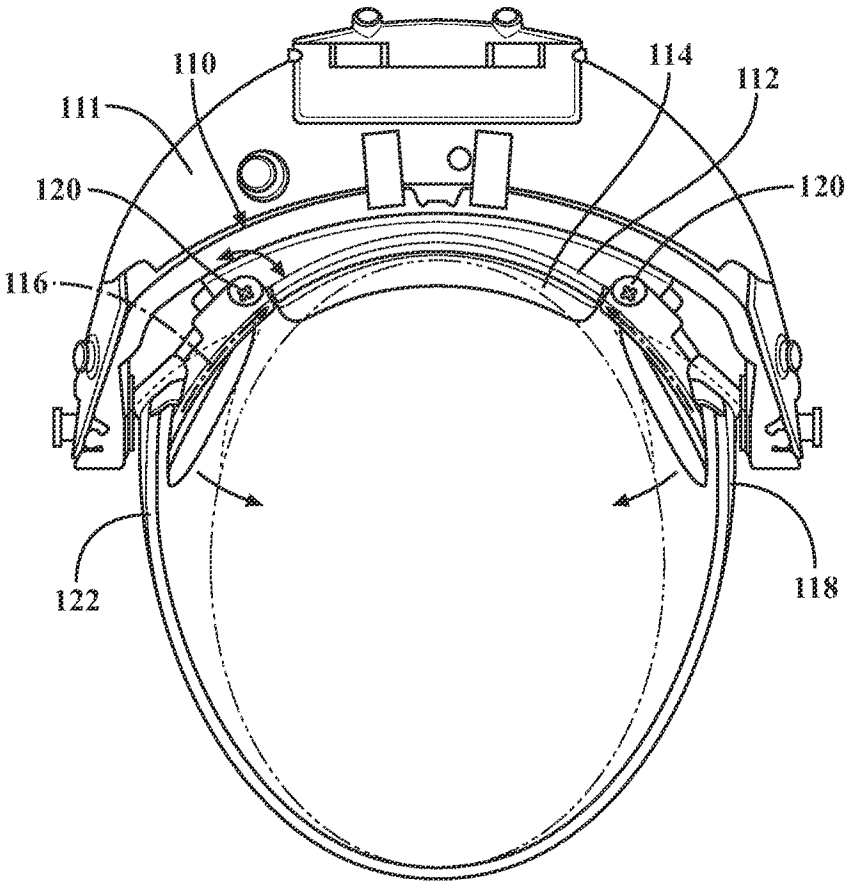
FIG. 8 is a top view of the adjustable forehead frame of the present invention.
Figure 10:
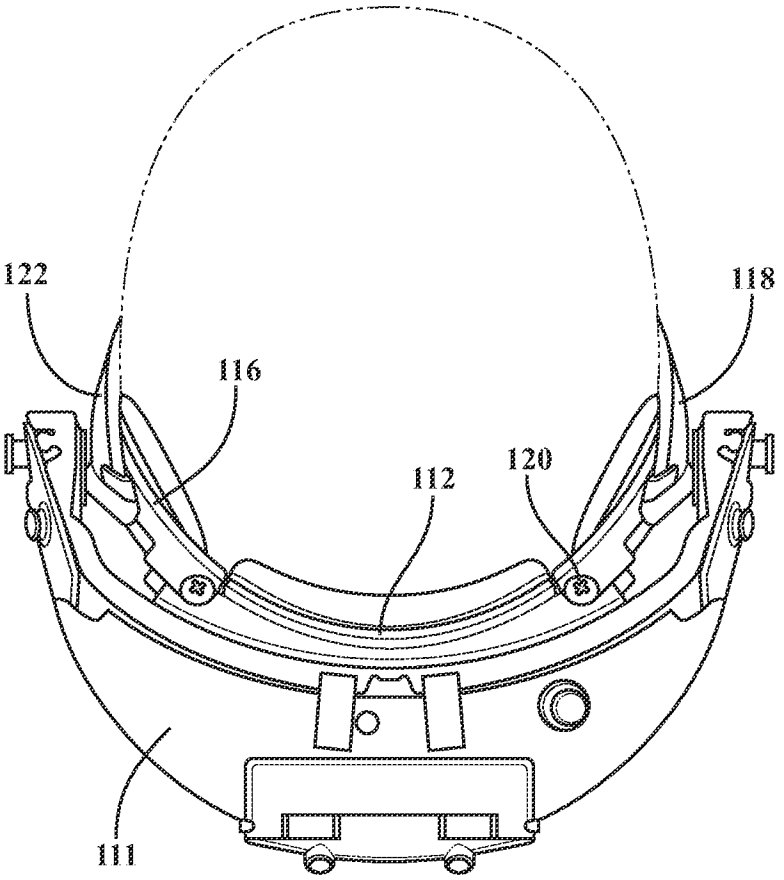
FIG. 10 is a top view of the adjustable forehead frame fitted to a user's head.
Figure 9:
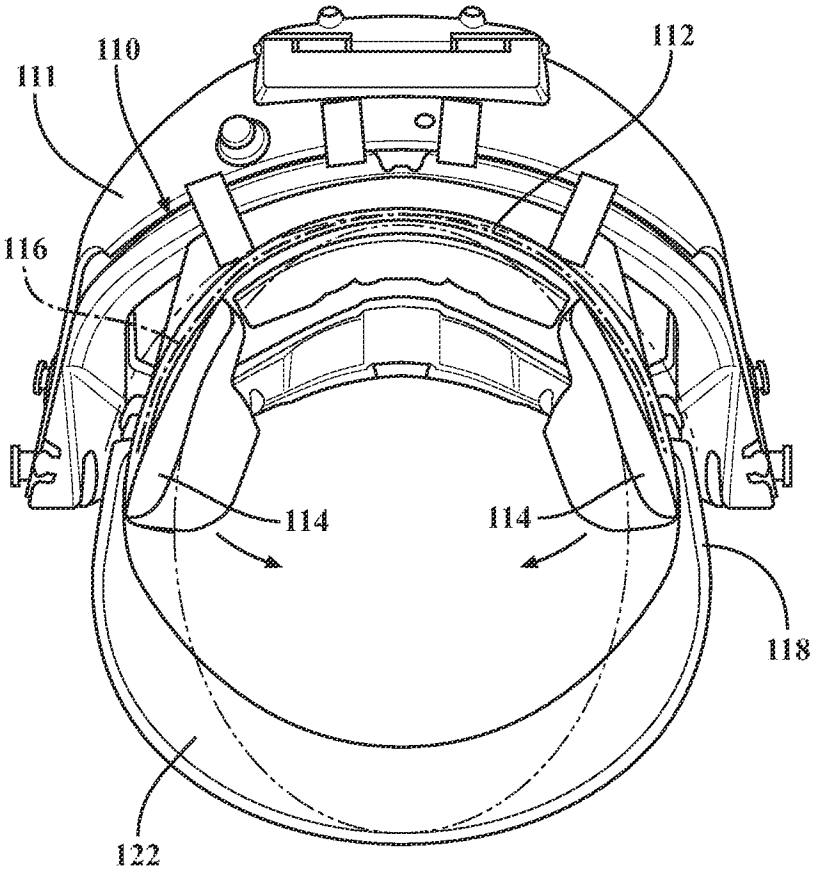
FIG. 9 is a top view of the adjustable forehead frame that can flex.

With reference to FIGS. 8 through 10, the adjustable forehead frame of the present invention is shown generally at 110. As illustrated, the frame 110 is attached to head top or head gear shown generally at 111. The head top 111 as illustrated is a face shield mounted in a frame. It is an example of gear that can be used with the present invention. Those of ordinary skill in the art will appreciate that other gear can be mounted to the frame 110 as desired, for example, a face shield without a frame, a respirator, a helmet, a light, magnifying glasses, etc. Overall, it would be useful for any application where something is mounted to a user's head.

In a first embodiment, shown in FIG. 8, the frame 110 includes a forehead member 112 that has an optional pad 114. The forehead member 112 is connected to the headgear 111. A first side wing 116 and a second side wing 118 are pivotally connected to the forehead member 112. The connection is shown as a hinge 120 and in particular a pivot pin 120 but could be any connection that allows for pivotal movement, such as for example, a mechanical hinge or a living hinge. As with the forehead member 112, the first and second side wings 116 and 118 could have pads 114 for added comfort.

An adjustment strap 122 adjusts the frame 110 to the user's head and either secures or helps to secure the frame 110 and the headgear 111 to the user. A flexible headband 122 is illustrated to pivot and flex the forehead frame 110. It will be understood by those of ordinary skill in the art that other adjustment mechanisms could be used, for example a user adjustable screw, a pivot with locking detents, a spring designed into the part which is nominally set for small heads and flexes open for larger, etc.

In use, the forehead member 112 is placed against the user's forehead. The illustrated strap 122 wraps around the user's head and provides the force to initially pivot the wings 116 and 118 around the pivot 120 bringing them into contact with the front side of the user's head and then flexes the wings 116 and 118 into contact with the forward sides of the user's head. It will be appreciated that the wings 116 and 118 can be made of any flexible material, such as for example, plastic, aluminum, steel, etc. In this way, the frame 110 of the present invention conforms to the user's head for a comfortable fit, see FIG. 10.

The forehead member 112 has a body portion 113 that has a first radius of curvature. The body portion 113 body has opposed free ends 115 and 117. The main body portion 113 is adapted to connect to headgear 111. The adjustment strap or head strap 112 is connected to the free ends. The head strap 112 draws the free ends 115 and 117 to a second radius of curvature which is less than said first radius of curvature to adjust the forehead frame 112 snugly against a user's head.

In a further embodiment, the wings 116 and 118 of FIG. 9 are flexible. In this embodiment, the wings 116 and 118 pivot into contact with the user's head.

In FIG. 9, the embodiment no pivots. The forehead member 112 and the wings 116 and 118 are a single piece. The forehead member 112 is central and the wings 116 and 118 extend from the forehead member 112. In this embodiment, the wings 116 and 118 flex to engage the sides of the user's head.

Figure 11:
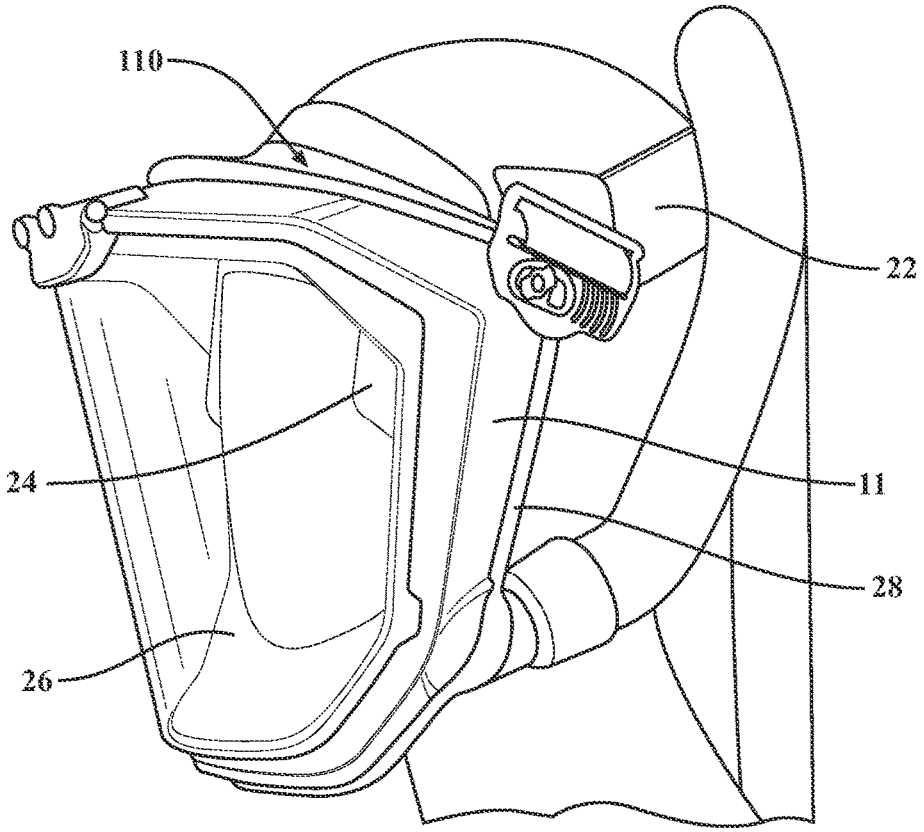
FIG. 11 is a perspective side view of the adjustable forehead frame.

The present invention also allows for options with respect to a face piece. A face piece that completely circles the face is not needed. If a seal is required, it can be split into two sections: the adjustable frame 110 with a foam pad 124 around the top half of the face and a fabric chin seal 126 around the bottom half of the face, see FIG. 11. The region between these two can have a more comfortable and lighter material 128 when compared to typical face shields. If sealing is not required, the headgear can have the adjustable frame 110 and if desired, a chin pad 126 or no chin pad.

Figure 12:
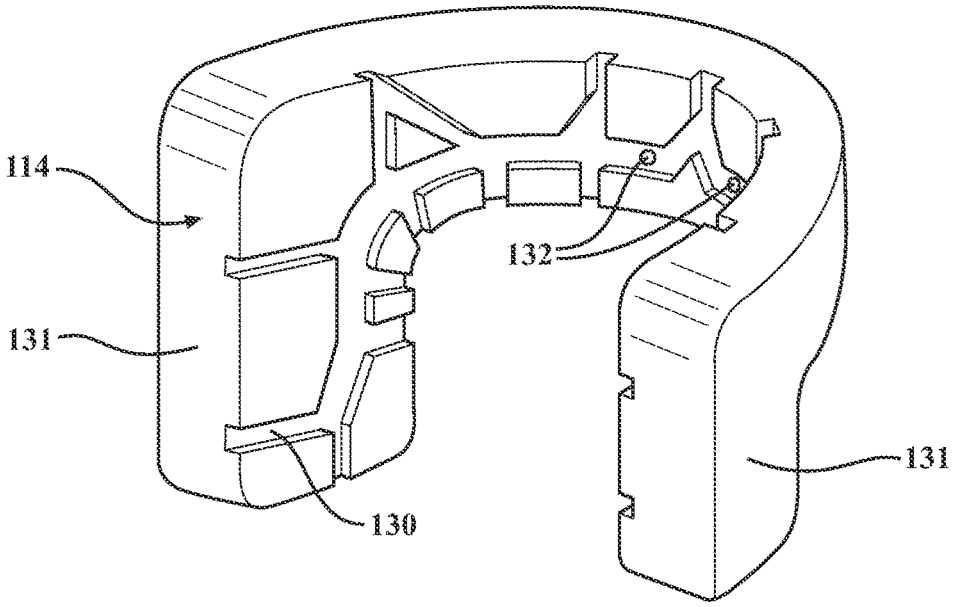
FIG. 12 is a perspective view of a head pad with air channels.

With reference to FIG. 12, a further feature of the present invention is illustrated. Channels 130 are provided in the pads 114 for air to flow over the forehead and escape along the sides 131 or over the top of the pad. Air outlets 132 can be provided to facilitate the escape of air. When wearing a head top with a brow pad, contact with the users head can make it difficult to cool down and often leads to sweating around the brow. The use of air channels allows for circulation of air and the escape of heat. As illustrated in FIG. 12, the air can flow over the users forehead and down the users face along the side members 131. The side members 131 also provide further support to the user since they engage the side of the face in addition to the forehead. Additionally, if air is supplied to the head gear, for example by a PAPR, air can flow from the air duct directly to the forehead through the brow pad. An example of a PAPR is the PX5® offered by applicant.

Figure 14:
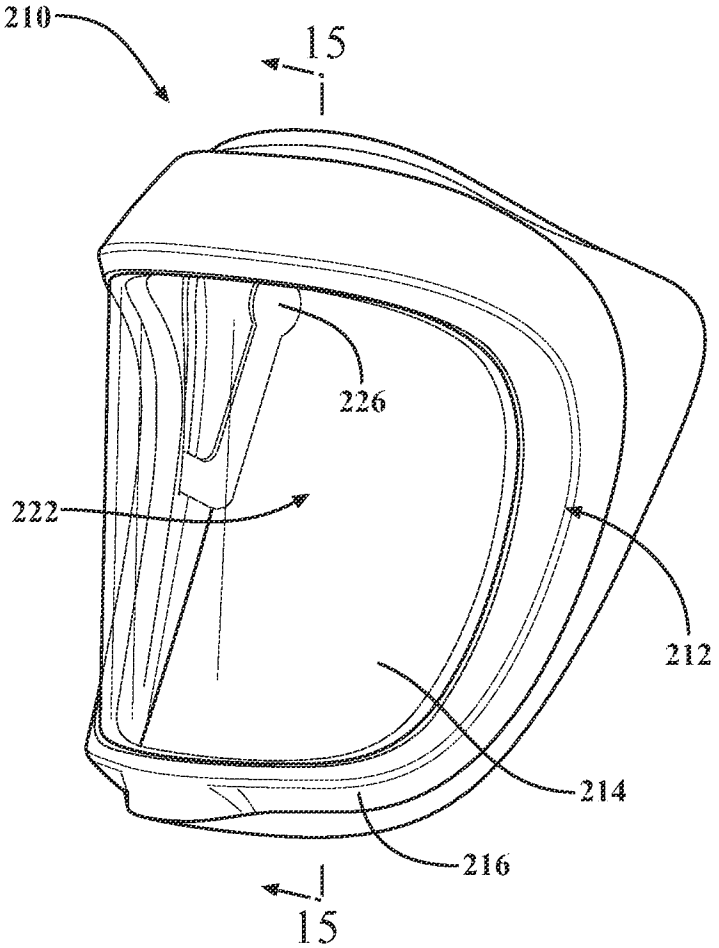
FIG. 14 is a perspective view of the self-sealing internal hinge respirator face shield in the closed position.
Figure 13:
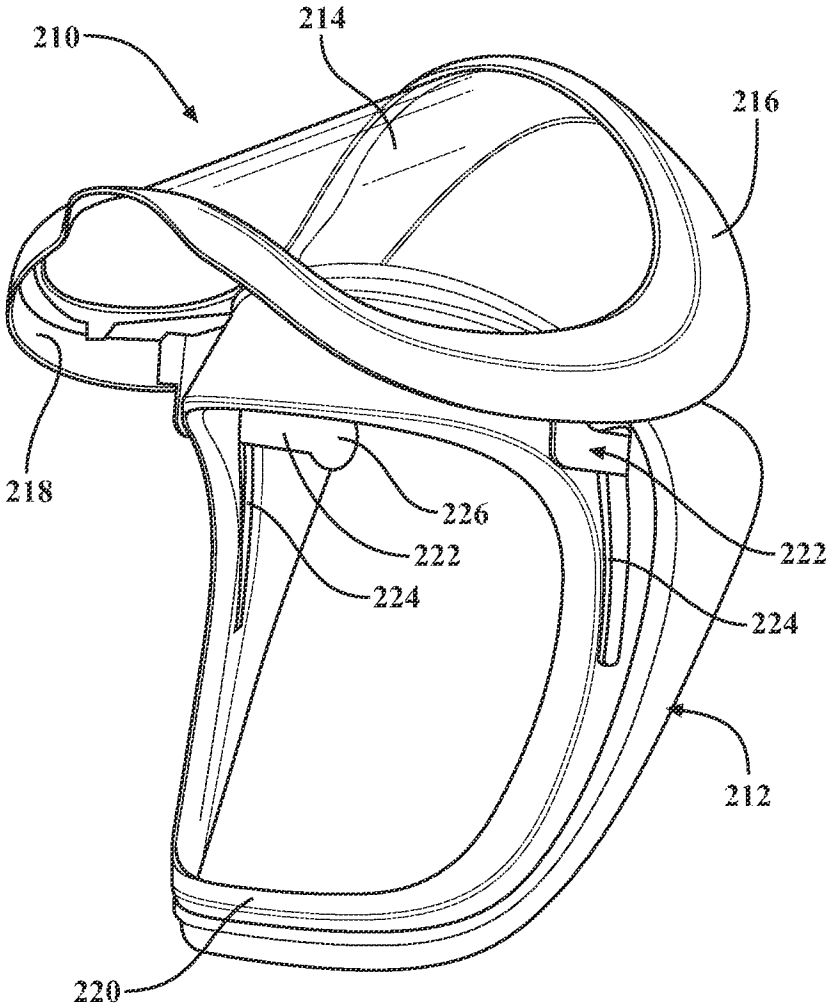
FIG. 13 is a perspective view of the self-sealing internal hinge respirator face shield of the present invention in the open position.
Figure 15:
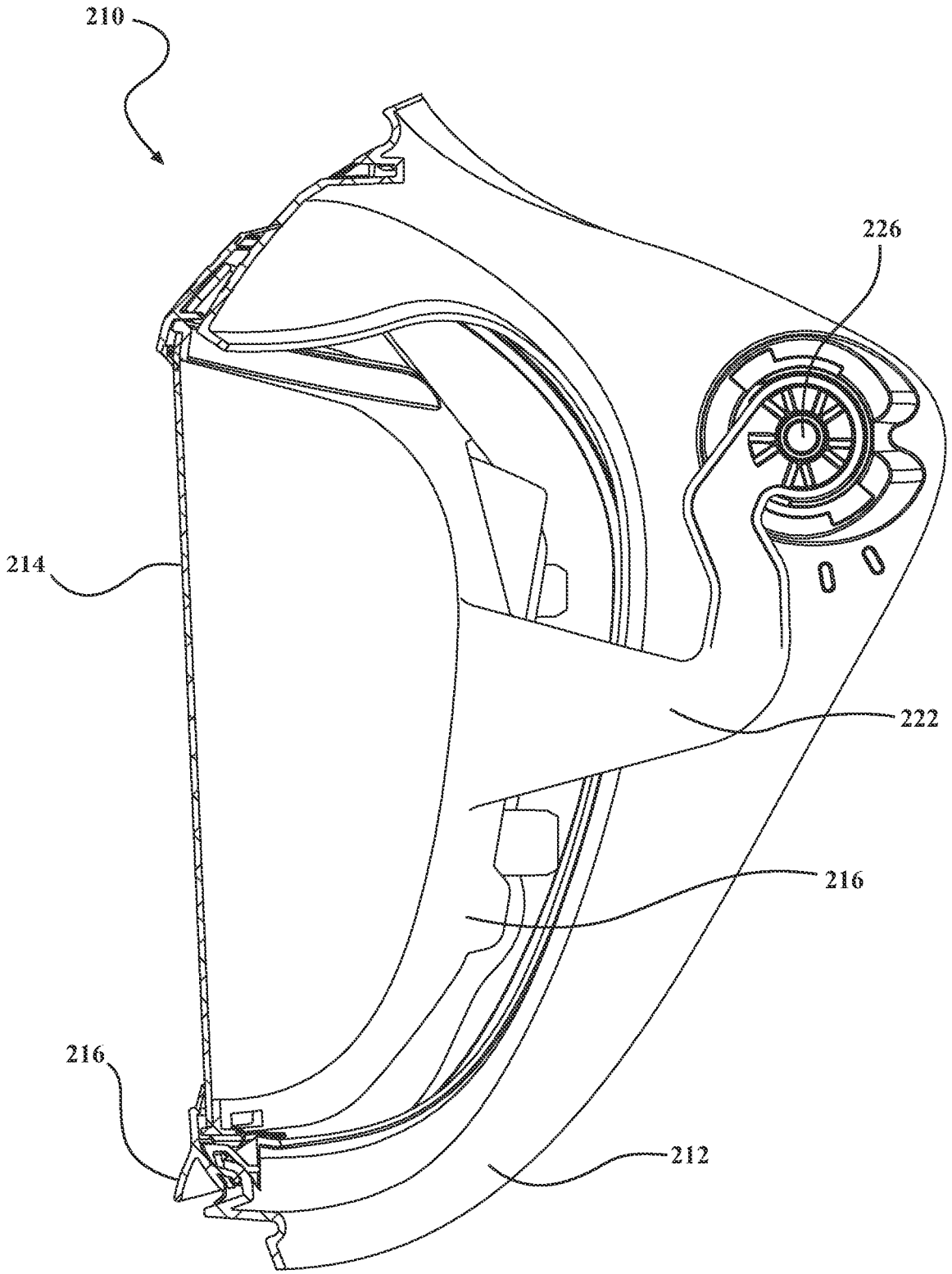
FIG. 15 is a cross section view of FIG. 14.

The self-sealing internal hinge respirator face shield of the present invention is shown generally at 210 in FIGS. 13 and 14. The face shield 210 includes a housing 212 and face shield 214. It should be appreciated that the housing 212 can be a frame, a shell covering part of the head, a helmet covering the entire head, or any other arrangement that uses a shield, all of which will be referred to as a frame or housing in the description and claims. It is to be understand that frame or housing includes all the possible variations of a face shield. The face shield 214 is mounted within a supporting structure 216. The structure 216 has a seal 218 which mates with a seal 220 on the housing 212. These seals 218 and 220 can take various forms, for example, they can be a soft rubber seal that is attached to the frame and housing, one of the other can be a soft rubber seal, they can be mating plastic surfaces, or a contoured cross section that mates with a contoured cross section of the opposite part.

Connecting arms 222 extend from the shield structure 216. The arms 222 extend through slots 224 or an opening in the housing 212 and are connected to a pivot point 226. Pivot point 226 is on the interior of the housing 212. The arms 222 have a pre-determined length that allows the shield 214 and frame 216 to pivot up and over the top portion of the housing 212 and the user. In this way, the centre of mass of the shield 214 and the structure 216 stay central and the wearer experiences less strain on their neck.

The internal hinge arms 222 also help pull the structure 216 inwardly to prevent the edges of the structure 216 from flaring and better assist in the mating of the seals 218 and 220.

The shield 214 and structure 216 can be used with a head gear or on a helmet. If used on a helmet, the structure 216 can be mounted to the helmet, or be integrally formed as the face opening of the helmet.

For respirators, especially in medical applications, internal hinges have the advantage that they are easier to clean. Basically, with the self-sealing internal hinge respirator face shield of the present invention the outer surface can be wiped down. There are no features that are visible or accessible from the outside. The big smooth surface is perfect for quick wipe-downs etc. Still, the shield 214 can be rotated open if needed. They also ensure a beneficial position of the opened shield 214 and structure 216 on top of the head gear or helmet and the head of the user. The centre of mass stays central and the wearer experiences less strain on their neck.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

We claim:

1. An adjustable head harness mount comprising:

an outer mount having a first connector for connecting the outer mount to a head top;

an inner mount having a second connector for connecting the inner mount to a head harness;

said second connector has two spaced receivers with slots for receipt of a strap on the head harness;

a hinge connecting said outer mount to said inner mount, said hinge allowing said inner mount to pivot with respect to said outer mount laterally with respect to one another to accommodate users with different head sizes;

whereby said adjustable head harness mount pivots to accommodate a user's head diameter.

2. The adjustable head harness of claim 1, further including a stability rail and a stability receiver, said stability rail being slidable within said stability receiver to provide guides for said inner mount to pivot with respect to said outer mount laterally with respect to one another to accommodate users with different head sizes.

3. The adjustable head harness of claim 1, wherein said first connector has a recess that receives a mating protrusion on the head top.

4. The adjustable head harness of claim 3, wherein said recess includes angled key ways for receipt of mating protrusions on the head top.

5. The adjustable head harness of claim 1, wherein said hinge is a living hinge.

6. The adjustable head harness of claim 1, wherein said hinge is a mechanical hinge.

7. An adjustable forehead frame comprising:

a forehead member having a body, said body having a first radius of curvature;

said body having opposed free ends;

said main body being adapted to connect to headgear;

first and second wings, said first wing extending from one of said opposed free ends and said second wing extending from the other of said opposed free ends; said first and second wings being movable with respect to said main body from a first position to a second position;

said first and second wings each having an adjustable second radius of curvature which is less than said first radius of curvature when said first and second wings are in said second position;

whereby said adjustable forehead frame snugly fits against a user's head.

8. The adjustable forehead frame of claim 7, further including a head strap connected to said first and second wings, said head strap adapted to draw said first and second wings from said first position to said second position to draw said forehead frame into a snug fit with a user's head.

9. The adjustable forehead frame of claim 7, further including a first hinge connecting said first wing to one of said opposed free ends and a second hinge connecting said second wing to the other of said opposed free ends.

10. The adjustable forehead frame of claim 9, wherein said hinge is a living hinge.

11. The adjustable forehead frame of claim 9, wherein said hinge is a mechanical hinge.

12. The adjustable forehead frame of claim 7, further including pads attached to said forehead member, said pad having channels to direct air over the user.

13. An adjustable forehead frame comprising:

a forehead member having a body, said body having a first radius of curvature;

said body having opposed free ends;

said main body being adapted to connect to headgear;

a head strap connected to said free ends;

said head strap drawing said free ends to a second radius of curvature which is less than said first radius of curvature;

whereby said adjustable forehead frame snugly fits against a user's head.

14. The adjustable forehead frame of claim 13, further including first and second wings, said first wing extending from one of said opposed free ends and said second wing extending from the other of said opposed free ends; said first and second wings being movable with respect to said main body from a first position to a second position;

said first and second wings each having an adjustable second radius of curvature which is less than said first radius of curvature when said first and second wings are in said second position;

whereby said adjustable forehead frame snugly fits against a user's head.

15. The adjustable forehead frame of claim 14, further including a first hinge connecting said first wing to one of said opposed free ends and a second hinge connecting said second wing to the other of said opposed free ends.

16. The adjustable forehead frame of claim 15, wherein said hinge is a living hinge.

17. The adjustable forehead frame of claim 15, wherein said hinge is a mechanical hinge.

18. The adjustable forehead frame of claim 13, further including pads attached to said forehead member, said pad having channels to direct air over the user.

19. A headgear comprising:

a frame for mounting on a user's head;

said frame having a viewing opening for a user to see out of said frame;

said viewing opening having a perimeter;

a shield mounted to said frame, said shield being movable between a first position wherein said shield covers said user opening and a second position wherein said viewing opening is exposed; said shield having a peripheral edge;

at least one pivot arm connecting said shield to said frame, said at least one pivot arm extending from adjacent said peripheral edge through into said frame;

whereby said at least one arm is concealed within said shield and said frame when said shield is in said first position.

20. The head gear of claim 19, including a seal around said frame.

21. The head gear of claim 19, wherein said at least one arm has a pre-determined length such that said shield pivots up and over the top portion of the frame and the user centrally maintaining the centre of mass of the shield and the frame whereby the wearer experiences less strain on their neck.

22. A head top comprising:

a frame for mounting on a user's head;

said frame having a viewing opening for a user to see out of a said frame;

said viewing opening having a perimeter;

a shield mounted to said frame, said shield being movable between a first position wherein said shield covers said user opening and a second position wherein said viewing opening is exposed; said shield having a peripheral edge;

at least one pivot arm connecting said shield to said frame, said at least one pivot arm extending from adjacent said peripheral edge through into said frame;

an outer mount having a first connector for connecting the outer mount to said frame;

an inner mount having a second connector for connecting the inner mount to a head harness;

a hinge connecting said outer mount to said inner mount, said hinge allowing said inner mount to pivot with respect to said outer mount laterally with respect to one another to accommodate users with different head sizes;

a forehead member having a body, said body having a first radius of curvature;

said body having opposed free ends;

said main body being adapted to connect to said frame;

a head strap connected to said free ends;

said head strap drawing said free ends to a second radius of curvature which is less than said first radius of curvature;

whereby said at least one arm is concealed within said shield and said frame when said shield is in said first position, said adjustable forehead frame snugly fits against a user's head and said adjustable head harness mount pivots to accommodate a user's head diameter.

23. The head top of claim 22 including a seal around said frame.

24. The head top of claim 22, wherein said second connector has two spaced receivers with slots for receipt of a strap on a head harness.

25. The head top of claim 22, further including a stability rail and a stability receiver, said stability rail being slidable within said stability receiver to provide guides for said inner mount to pivot with respect to said outer mount laterally with respect to one another to accommodate users with different head sizes.

26. The head top of claim 22, wherein said first connector has a recess that receives a mating protrusion on the head top.

27. The head top of claim 26, wherein said recess includes angled keyways for receipt of mating protrusions on the head top.

28. The head top of claim 22, wherein said hinge is a living hinge.

29. The head top of claim 22, wherein said hinge is a mechanical hinge.

30. The head top of claim 22, further including first and second wings, said first wing extending from one of said opposed free ends and said second wing extending from the other of said opposed free ends; said first and second wings being movable with respect to said main body from a first position to a second position;

said first and second wings each having an adjustable second radius of curvature which is less than said first radius of curvature when said first and second wings are in said second position;

whereby said adjustable forehead frame snugly fits against a user's head.

31. The head top of claim 30, further including a first hinge connecting said first wing to one of said opposed free ends and a second hinge connecting said second wing to the other of said opposed free ends.

32. The head top of claim 31, wherein said hinge is a living hinge.

33. The adjustable forehead frame of claim 31, wherein said hinge is a mechanical hinge.

* * * * *